United States Patent [19]

Milianowicz

[11] 3,946,183

[45] Mar. 23, 1976

[54] PUFFER PISTON GAS BLAST CIRCUIT INTERRUPTER WITH INSULATING NOZZLE MEMBER

[75] Inventor: Stanislaw A. Milianowicz, Monroeville, Pa.

[73] Assignee: Westinghouse Electric Corporation, Pittsburgh, Pa.

[22] Filed: Apr. 5, 1974

[21] Appl. No.: 458,255

[52] U.S. Cl. ..... 200/148 A
[51] Int. Cl.[2] ..... H01H 33/88
[58] Field of Search..... 200/148 A, 150 G, 148 G

[56] References Cited

UNITED STATES PATENTS

| | | | |
|---|---|---|---|
| 3,291,948 | 12/1966 | Telford | 200/148 A |
| 3,659,065 | 4/1972 | Roidt et al. | 200/148 A |
| 3,814,883 | 6/1974 | Milianowicz | 200/148 G |

*Primary Examiner*—Robert S. Macon
*Attorney, Agent, or Firm*—W. R. Crout

[57] ABSTRACT

A gas blast circuit interrupter of the puffer piston type is provided having one relatively solid contact and one vented contact which make valve closed engagement in the closed position. In all embodiments of the invention, the insulating nozzle and the vented contact are fixedly interconnected by means of a vented electrically conducting ring. The vented contact comprises a cluster nozzle for venting gas during contact parting and for grasping the solid conductor during contact. The ccoperating arrangement among the parts allows the puffer gas to vent through parallel paths.

11 Claims, 5 Drawing Figures

PUFFER PISTON GAS BLAST CIRCUIT INTERRUPTER WITH INSULATING NOZZLE MEMBER

BACKGROUND OF THE INVENTION

This invention relates to a puffer or piston type fluid blast circuit interrupter in which a piston structure provides a desirable fluid blasting action during contact separation with the fluid flow passing over the arc to effect its extinction. Cromer et al, U.S. Pat. No. 3,095,490 teaches generally a fluid blast circuit interrupter of a type in which the separation in the contact structure is deliberately delayed until a predetermined pressure buildup occurs. Frink et al, U.S. Pat. No. 3,588,407 teaches a gas blast circuit interrupter of the puffer type where gas is vented in parallel paths but where both parallel paths are internal to a pair of hollow conductors. Saffold et al, U.S. Pat. No. 3,555,225 teaches a gas blast circuit interrupter similar to that which is taught in the previously described Frink et al patent but where the insulating nozzle is always relatively stationary. Baker, U.S. Pat. No. 2,933,575 teaches a circuit interrupter of the gas blast type where the nozzle or the insulating portion may move not only relative to the separable contacts but also relative to other fixed portions of the circuit breaker which in turn are fixedly attached to at least one of the separable contacts. It would be advantageous to provide a circuit interrupter of the gas blast puffer piston type wherein a hollow electrical contact and an electrically insulating puffer nozzle are provided in fixed relationship with each other for engagement with a relatively solid electrical conductor and where compressed insulating arc-extinguishing gas is provided between the annular conductor and the solid conductor during an interrupting operation. It would be further advantageous if the gas was provided with dual or parallel paths for venting into ambient pressure regions of the circuit interrupter after the interruption operation has begun. It would be further advantageous to provide one of these latter parallel paths for gas venting through the annular conductor and the other parallel path for gas venting around the outer surface of the solid conductor rather than through it.

SUMMARY OF THE INVENTION

According to the invention, a circuit interrupter of the gas blast puffer piston type is taught which includes a number of useful embodiments. In one embodiment of the invention, a relatively fixed annular electrical contact is provided. The opening provides a contiguous gas venting path between the region of arc extinction and a region of ambient gas pressure. Fixedly disposed upon the latter named contact, in an electrically insulating nozzle member which is held in fixed relationship with the latter named contact by way of an electrically conducting support member having openings or port holes therein for allowing gas to flow therethrough from a region of high gas pressure to the region of the arc of interruption and thence to the region of ambient gas pressure. A relatively solid or non annular electrical conductor which is movable by the linkages of the circuit breaker is provided to engage with clustered fingers that are disposed in the annular fixed contact in a gas sealing relationship. When circuit breaker or circuit interrupter opens an arc is drawn as the solid conductor is moved away from the cluster fingers of the fixed conductor and accumulated pressurized gas is provided to the region of the interrupting arc of interruption whereafter it is provided by way of dual venting paths into a region of ambient gas pressure. The first of the dual gas venting paths is through the annular portion of the previously described fixed conductor. The second of the paths for gas venting is through the annular portion of the insulating shield or nozzle but around the outer periphery of the relatively solid moving conductor during a portion of the opening operation. In another embodiment of the invention, the relatively solid conductor is maintained in a fixed position but the annular conductor, the previously described electrically conducting ring, the electrically insulating fixedly attached nozzle, and the cylinder member are all interconnected for movement relative to the solid conductor. The parallel gas paths for arc extinction and venting, however, function the same as in the formerly described embodiment of the invention because of the structural and motion relationships of the elements.

BRIEF DESCRIPTION OF THE DRAWINGS

For a better understanding of the invention, reference may be had to the preferred embodiments exemplary of the invention shown in the accompanying drawings, in which.

DESCRIPTION OF THE PREFERRED EMBODIMENTS

Figure 1:
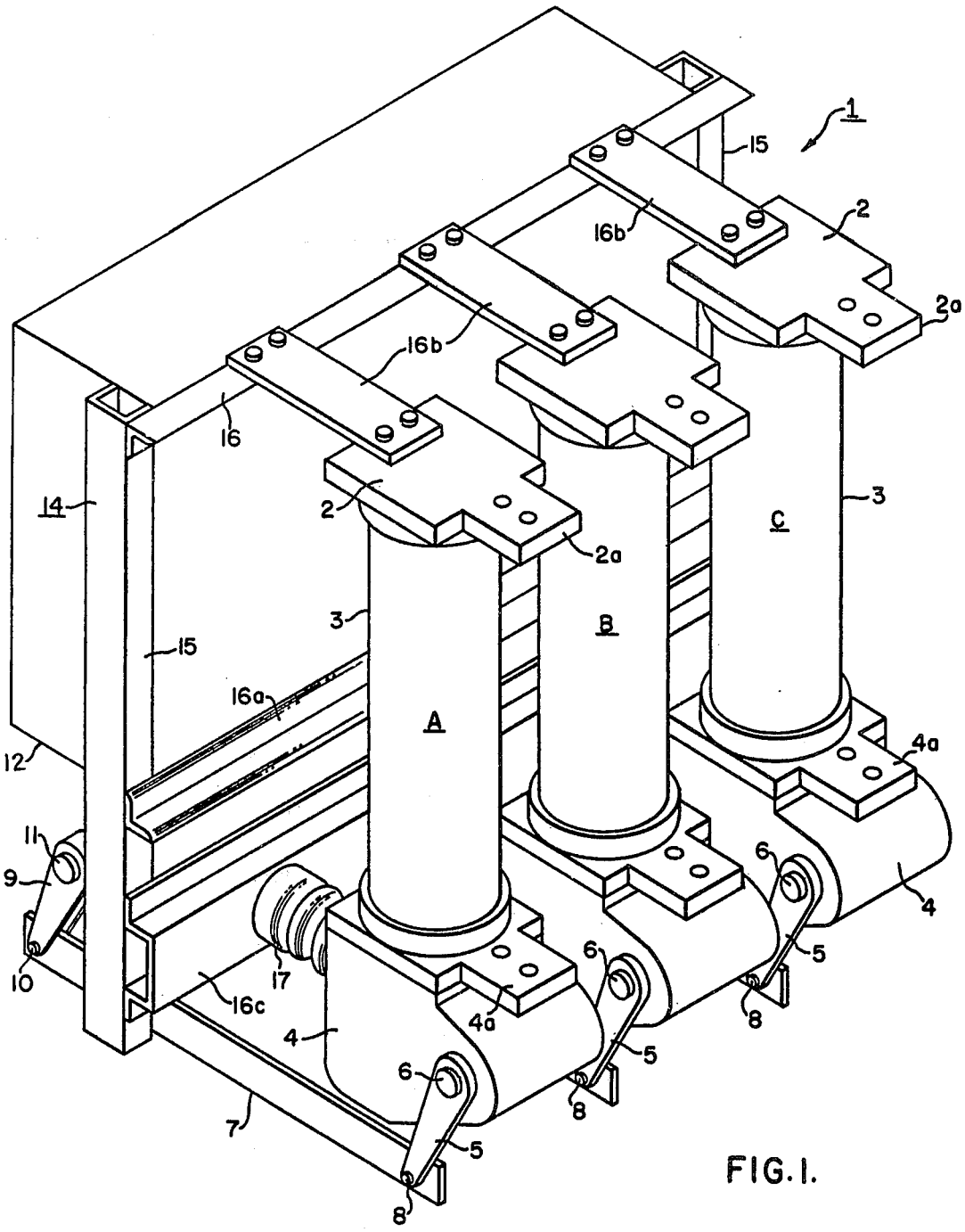
FIG. 1 is a view of a three phase circuit interrupter of the type capable of utilizing the invention described herein.

Referring to the drawings, and more particularly to FIG. 1 thereof, a reference numeral 1 generally designates a three-pole fluid-blast circuit interrupter comprising three spaced pole assemblies A, B and C. As will be apparent from FIG. 1, each pole assembly includes, generally, an upper end plate 2, a generally upstanding cylindrical housing 3, and a lower end plate and mechanism housing 4. Disposed exteriorly of the mechanism housing 4 is a drive crank 5 affixed to an operating shaft 6, and a generally horizontally reciprocally movable insulating operating rod 7 is pivotally secured to the external operating crank 5, as at 8, and is connected to a drive crank 9 through a pivotal connection 10. The three drive cranks 9, only one of which is shown, are affixed and rotatable with an operating drive shaft 11, which is connected to a suitable mechanism 12, which constitutes no part of the present invention, and may be of the type set forth in U.S. Pat. No. 3,183,332, issued May 11, 1965, to Russell E. Frink and Paul Olsson, and assigned to the assignee of the present invention.

It will be apparent from FIG. 1 that a suitable supporting grounded framework 14 is utilized comprising vertical channel members 15 with interbracing structural steel members **16, 16*a* having horizontally extending insulating support straps 16*b* secured thereto, which assist in supporting the interrupting assembles assemblies. Additionally, lower insulator supports 17 may be employed extending generally horizontally from a channel support member 16***c*, the latter being affixed to the vertical support channels 15.

Referring now to FIG. 2, one embodiment of the invention is shown. At the top or one end of the embodiment shown in FIG. 2, the end plate 2 (which may be an upper end plate) having tapped holes therein for the attachment of an electrode from an electrical circuit to be protected by the circuit interrupter. There is also shown an annular circular flange 2B which is disposed transverse to the end plate 2 and is conveniently attached thereto such as by bolting or welding. Disposed in a spaced relationship from the end plate 2 is the mechanism housing 4 which comprises a terminal portion 4A having a hole therein for the acceptance of an electrode or terminal from another portion of the previously described external circuit to be protected by the circuit interrupter. The mechanism housing 4 has a part thereof, an annular tubular flange 4C similar to flange 2B. Flange 4C is conveniently disposed upon terminal portion 4A of mechanism housing 4. Shown within the mechansim housing 4 is an operating shaft 6 and attached levers 5 and 19, lever 5 representing the operating crank 5 and lever 19 representing the lever for moving a pivotally interconnected driving rod 21, the use of which will be described hereafter. Mechanism housing 4 has a tapped hole or similar fastening or securing means 4B for adapting the housing 4 to an insulating means such as 17 shown in FIG. 1. At the end portion of the interrupter, is shown a generally tubular copper alloyed electrically conducting electrode 30, electrode 30 is fixed to terminal 2 in a convenient manner such as by brazing or bolting. Electrode 30 has an annular inner portion 34 connected at one end thereof to two oppositely disposed venting holes 34A and 34B which provide a contiguous opening or path between the annular axially aligned hole or opening 34 and an ambient gas pressure region 61 within the circuit interrupter. An annular tubular metal nozzle 36 is provided to be brazed and/or screwed into a tapped portion of the conductor 34 at a point 36C. The metal nozzle 36 comprises electrically conductive material such as copper or copper alloy and is formed into the shape of a hub from which protrude circumferentially disposed elongated fingers generally designated 36B having at the tip or end portions thereof highly conductive arc resistant portions 36A, which may otherwise be known as the finger tips of the fingers 36B. The finger tips 36A may comprise a tungsten or copper alloy material which is highly arc resistive. It is at this portion of the circuit interrupter that an arc root is likely to strike or reside during an opening or interrupting operation. It will be noted that the slotted finger portions 36B are flexible in a transverse or radial direction relative to the axis of the conductor member 30. Disposed at one end of the annular electrical conductor 30 is a widened or trumpeted portion 38 which extends radially outward around the outer portion of the conductor 30. The trumpeted portion or cooler casting 38 comprises a plurality of ribbed sections circumferentially disposed around the outer conductor 30 in a spoke-like manner. In the drawing of FIG. 2, the openings between adjacent spoke-like ribs are designated 38A and these openings provide a contiguous path between a pressurized gas chamber 60 and a region of arc interruption 74. In a preferred embodiment of the invention the cooler casting 38 may comprise thirty generally equally spaced, radially disposed ribs having venting or contiguous ducts 38A disposed therebetween.

An electrically insulating and arc resistant horn or shielding member 40, which may be Teflon, is provided to be conveniently attached to an inner portion of the cooler casting 38 at a region 42. The electrically insulating and arc resistant enclosure or horn 40 may be conveniently screwed into the casting 38 at the region 42. The horn 40 has a trumpeted or outward flaring or tapered annular central opening which is contiguous with the previously described region of arc interruption 74. This widened region is designated 40A. The annular conical inner portion of the member 40 comprises slotted axially spaced grooves 44 which are useful for providing increased electrical insulation along the inner surface of the horn member 40. This is described in a U.S. Pat. No. 3,291,948 issued Dec. 13, 1966 by J. M. Telford. The previously described links or linkage members 21 which are pivotally attached to the lever member 19 are pinned at one portion thereof by means of a pin 22 to an aluminum alloy spider casting generally designated 24. Spider casting 24 has a hub portion 25 through which is disposed a generally solid electrically conducting copper or copper alloy contact rod 28 which is not movable in relationship with the previously described spider member 24. Also fixedly attached to spider member 24 by way of pins 25 is an electrically insulating thin wall cylindrical tube 23 which is utilized for developing the previously described necessary gas pressure for causing the gas blasting of an arc in region 74 during an interruption operation. Cylindrical member 23 has at one end thereof an enclosing integral annular disc portion 54 which has a round or circular hole 56 therein through which the outer periphery of the previously described electrically conducting rod 30 may slidably protrude. There is at the innerface region between the annular surface 56 of the integral disc 54 and the electrically conducting rod 30 a gas seal against the escape of gas from the chamber 60 to the region of ambient gas pressure 61. The previously described casting member 38 has provided at the outer periphery thereof a gas seal gasket 52 which prevents the leakage of pressurized gas under normal operating conditions from the high pressure gas chamber 60 to another region of ambient gas pressure 61A.

In the embodiment shown in FIG. 2, the circuit interrupter is shown in a partly open state, that is, with a gap between the electrical conductor 30 and the electrical conductor 28. Gas flow arrows are shown which generally designate the paths through which puffer gas flows during the arc extinguishing operation. The gas flows start in the high pressure region 60 where an insulating gas such as sulfur hexafluoride $SF_6$ is compressed during an opening operation between the piston member 54 and the outer surface of the electrode 28 as electrode 28 moves out of contact with the fingers 36A of the cluster 36 from a position generally designated 80 in FIG. 3. As the tip 46 of the contact 28 clears the opening 72, compressed gas rushes through duct or ducts 38A into region 74 where an arc may be playing between the tungsten carbide or arc resistant tip 46 of the solid electrode 28 and the finger tips 36A of the cluster or metal nozzle 36. The path for the onrushing gas through the duct or port 38A is generally designated by the reference numeral 84. Once in the arc extinguishing region 74 however, the gas is provided with two parallel paths for venting to relatively low or ambient gas pressure regions 61 and 61A each of which comprise part of a common volume. One parallel path is generally designated 88 and is provided upwardly through the annular portion of the electrode 30 to the previously described exit ports 34A and 34B. The other path is downwardly and as indicated by the reference numeral 86 downwardly across the outer surface of the tungsten tip 46 of the electrode 28 through the widened region of the electrically insulating horn or shield member 40 to the other lower region of ambient gas pressure 61A. A relatively short round or annular opening 48 is provided axially in the relatively solid electrode 28. A cross opening 50 communicates between the latter mentioned round opening 48 and the outer circumference of the electrode 28. This region is not provided for significant gas flow such as indicated by the arrow 86 but is rather provided for thermodynamic purposes.

Figure 2A:
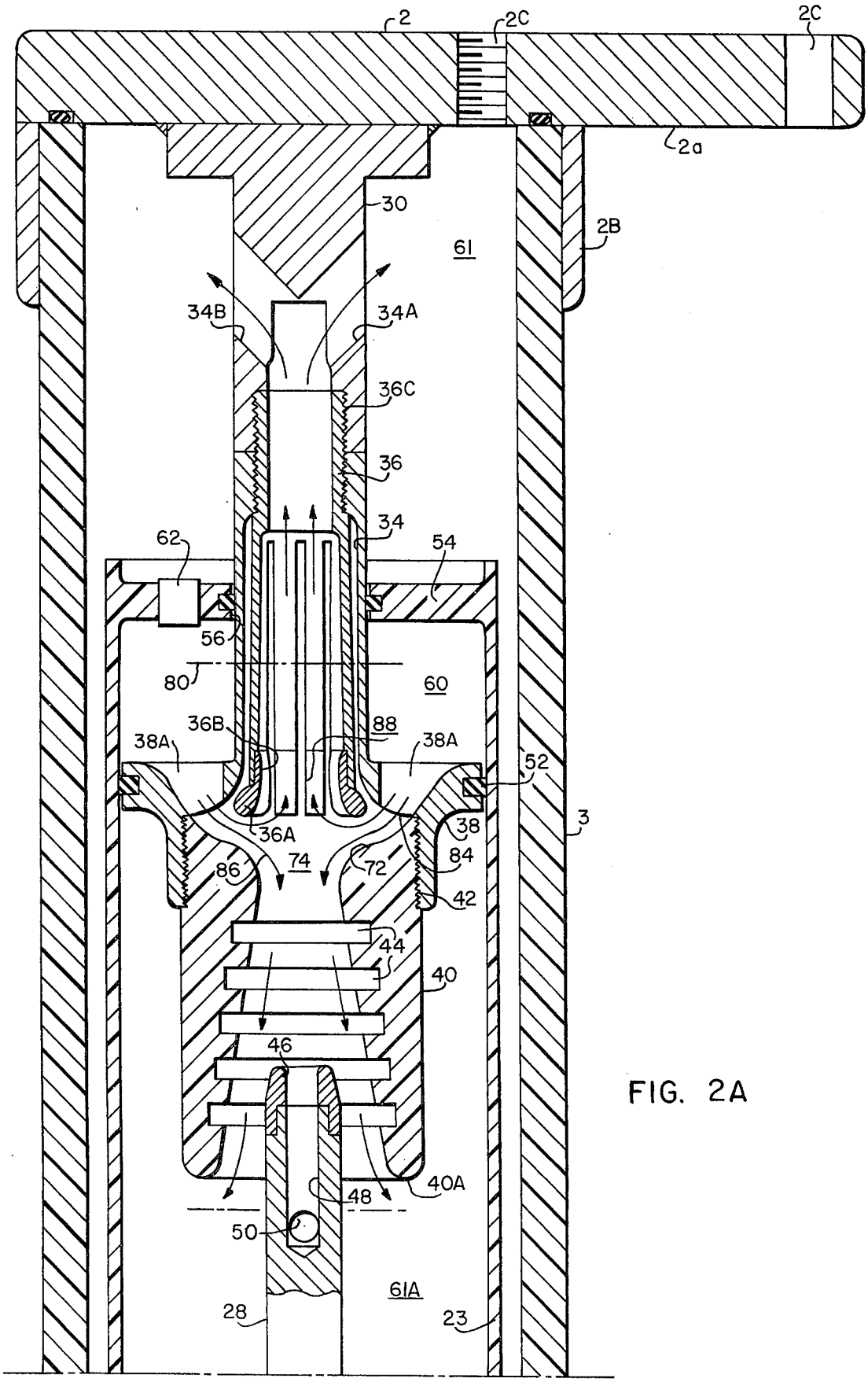
FIG. 2 (as shown in portions 2A and 2B) is a side elevation in section of a circuit interrupter of the type disclosed as the invention where the circuit interrupter is in the open position.
Figure 2B:
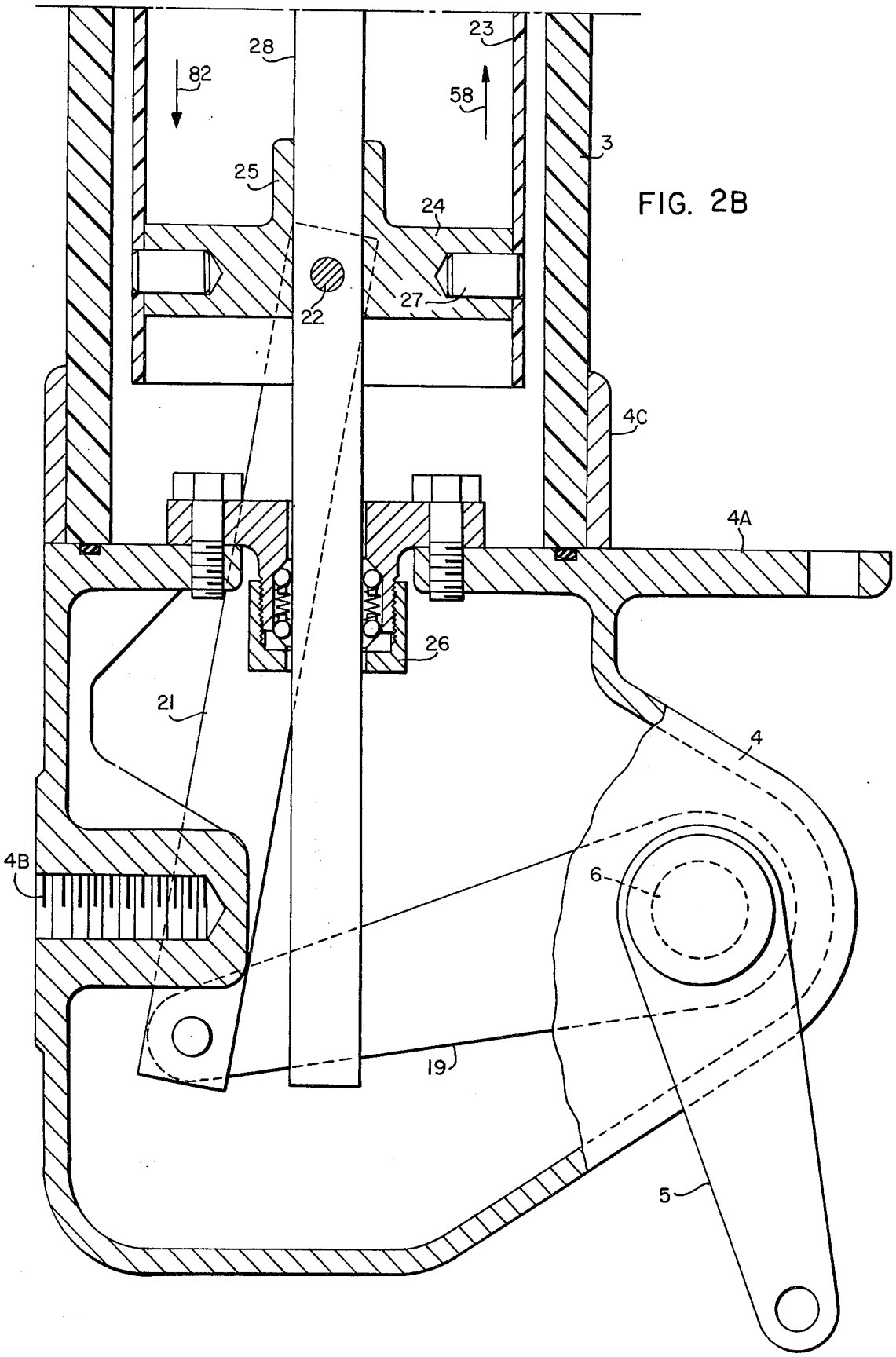

The previously described operation generally occurs as the generally solid lower electrode 28 is being moved in a direction generally designated 82 in FIG. 2B. This corresponds to an opening operation of the circuit interrupter. When the circuit interrupter contact 28 is upwardly in the direction 58, corresponding to a closing operation, the chamber 60 increases in volume. A valve 62 is provided in the annular piston member 54 which is unidirectional and allows ambient gas to flow into the chamber 60 as the linkage members of the circuit interrupter cause the contact 28 to move in the closing direction 58. This prevents a vacuum from occurring in chamber 50 which would act to retard the movement of the contact 28 in the closing direction and ensures that volume 60 is filled with gas in readiness for an opening operation which may occur immediately upon completion of closing operation. It should be clearly noted that the contact 28 is fixedly attached to the hub member 25 of the aluminum alloy spider casting 24 which in turn is fixedly attached to the thin walled electrically conducted insulating cylinder 23. It should be understood that insulating cylinder 23 may comprise any of a number of standard insulating materials such as but not limited to, insulating fiberglass, dacron epoxy, glass epoxy or polycarbonate. It should also be noted with respect to the embodiment of FIG. 2 that the insulating shield or horn member generally designated 40 as well as the cooler casting generally designated 38 and the relatively fixed electrode generally designated 30 are all attached together. It should also be especially noted with respect to the embodiment of FIG. 2 that the gas flow path generally designated 86 provides arc interrupting gas puffer action around the outer surface of the tungsten or arc resistant tip 46 of the movable contact 28.

Figure 3:
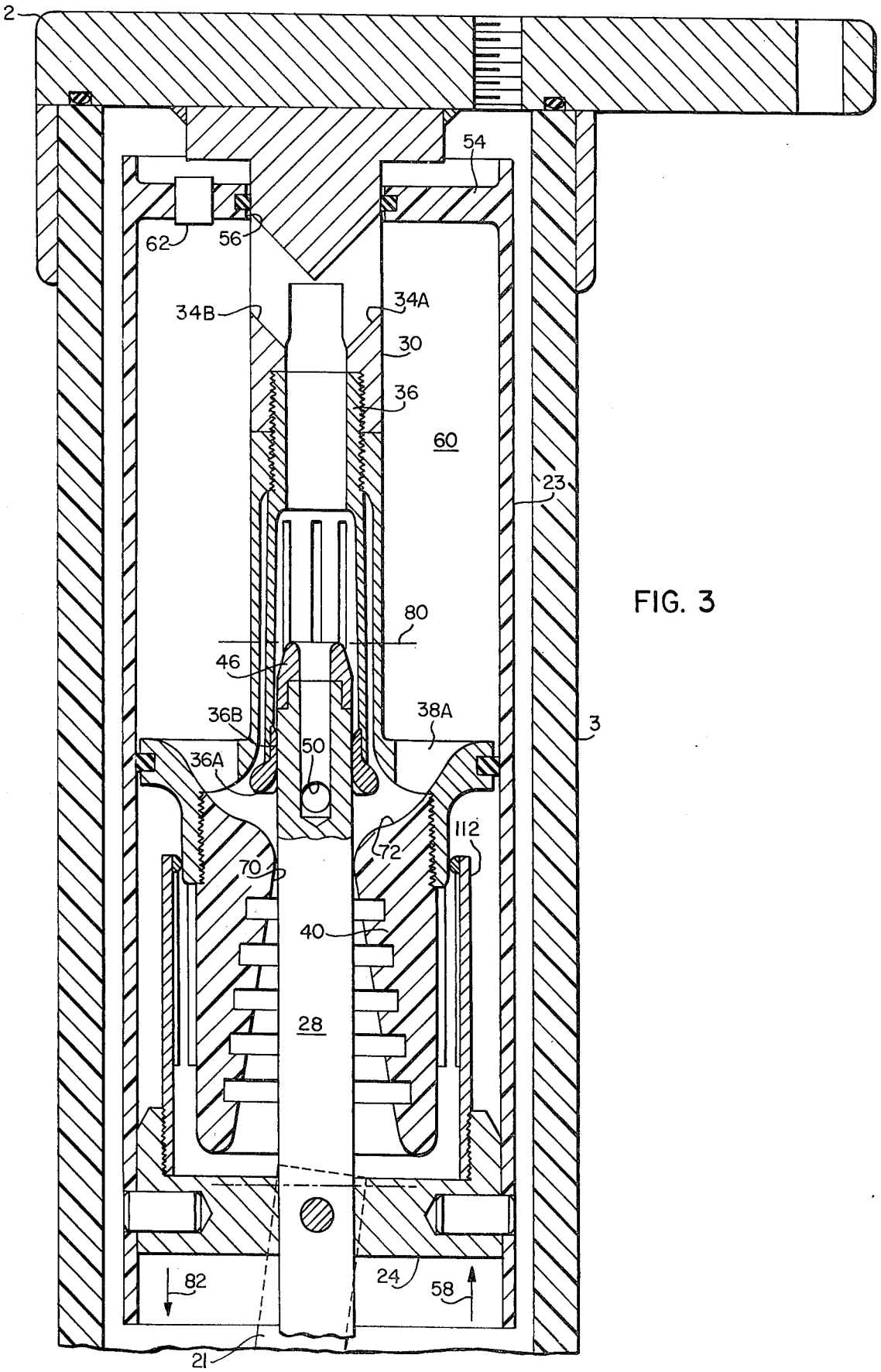
FIG. 3 is a view of an embodiment similar to the embodiment shown in FIG. 2 but in the closed or electrically conducting position.

Referring now to FIG. 3, a cutaway portion of the embodiment of the invention shown in FIGS. 2A and 2B is shown with the circuit breaker in the closed or electrically conducting position. For purposes of simplicity, the mechanism housing portion 4 of FIG. 2 is broken away in FIG. 3. The outer electrically insulating housing 3 as well as the upper terminal 2 (in simplified form) is once again shown. Also shown is the generally stationary electrode 30 having disposed in an annular portion thereof the metal cluster nozzle 36. In this embodiment of the invention, the linkage 21 is presumed to have moved upwardly to cause the generally solid contact 28 to protrude into the fingered portion 36B of the stationary contact 36 and well into the inner region of the hollow electrode 30. The foremost extension of travel of the movable contact 28 upwardly is indicated by the termination line 80. It will be noted that the fingered portions of the hollow electrode 30 and the solid electrode 28 are in intimate electrical contact for the transmission or transfer of electrical current between the electrode 30 to the electrode 28. It will also be noted that the piston chamber 60, formed by the generally hollow cylindrical electrically insulating casing 23, is expanded. In this position, compression chamber 60 is filled with insulating gas, such as sulfur-hexafluoride ($SF_6$) gas at an ambient pressure. It will also be noted that the transient gas blocking solid electrode 28 abuts the narrow neck portion of the nozzle 40 at a restriction 70 to temporarily seal the duct 38A at the port hole 72. As the movable contact 28 is caused to move downwardly such as would occur during an interrupting operation, the cylinder 23 moves in direction 82 causing the gas seal 56 on the annular disc member 54 to travel past the vent openings 34A and 34B so that gas may be puffed out or pushed out of the chamber 60 through the duct 38A into the region to cause interruption of an arc, which may be established between the stationary contact fingers 36A and the movable contact extremity 46.

Figure 4:
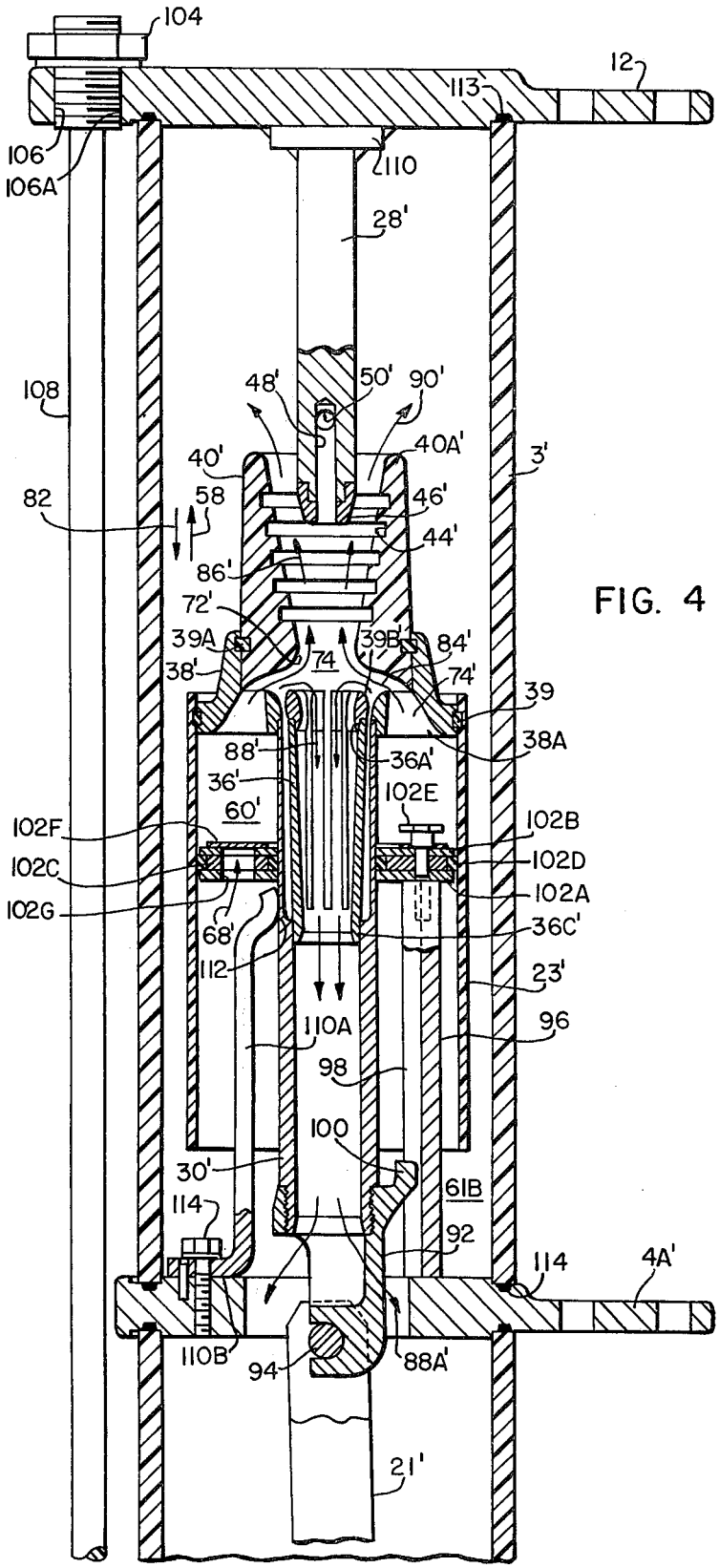
FIG. 4 is a view similar to that shown in FIGS. 2 and 3 but utilizing a different embodiment of the invention.

Referring now to FIG. 4, another embodiment of the invention is shown. In this embodiment of the invention, the external appearance of the interrupter may be very similar to that shown in FIG. 2, although it is to be realized that the external appearance is not limiting. An upper line terminal 12 is provided having suitable holes for interconnection with an electrical circuit to be protected. A bottom line terminal 4A' is also shown. An electrically insulating hollow cylindrical tubular casing member 3' is disposed between the previously mentioned line terminals 12 and 4A'. Terminals 12 and 4A' are sealed or joined respectively in this embodiment of the invention with neoprene rubber gaskets 113 and 114 respectively. There is also provided at least two holes 106 in one portion of the terminal 12 in which a metallic tapped portion 106 of a generally electrically insulating tie rod 108 is disposed and secured by way of nuts 104. The lower end of the tie rod 108 is not shown. In this embodiment of the invention the tie rod 108 is utilized for keeping the stacked portions of the interrupter securely held together. This embodiment of the invention differs from the embodiment illustrated in FIG. 3 in that the generally solid contact 28' remains fixed in this case, but the generally hollow venting contact 30' is movable along with the rigidly affixed cooler casting 38', and the rigidly affixed horn or electrically insulating orifice nozzle generally designated 40'.

In this embodiment of the invention, unlike the embodiment of the invention of FIG. 3, the thin walled electrically insulating cylinder 23' is movable with the other movable portions of the invention. A generally fixed annular disc member 102 allows for compression of gas within the region 60'. In this embodiment of the invention, the generally fixed solid electrode 28' has a hole 48' with communicating transverse holes 50' for the purpose previously described. The generally fixed or solid contact 28' is brazed or screwed into a copper pad 110, which is, in turn, brazed upon or screwed into a bottom portion of the line terminal plate 12. In all embodiments of the invention, the terminals such as 12, 2A, 4A and 14 may comprise an aluminum or an aluminum alloy, copper or a copper alloy material. The nozzle 40' has the previously described axially spaced grooves 44' which serve the same purpose as the slots or grooves 44 depicted in the embodiment of FIG. 2. In addition, the trumpeted or opened end of the horn or shield 40' is generally designated 40A' in this embodiment of the invention. There is provided between the outer portion of the horn 40' and the inner portion of the cooler casting an epoxy fastening portion generally designated 39A. This causes the horn 40' to be held in fixed relationship with the cooler casting 38'. In a similar manner, the outer portion of the cooler casting 38' is held in fixed relationship with the thin walled compression cylinder 23' by a similar cement portion 39. The cooler casting 38' is disposed in integral fixed relationship with the movable annular electrode 30'. Annular electrode 30' has a metal cluster nozzle 36 disposed in the annular portion of the electrode 30 and secured thereto at a region 36C by screwing, brazing or both. It is to be understood that the electrode 30' may comprise a copper or copper alloy material. As was the case with respect to the embodiment of FIGS. 2 and 3, the cluster nozzle region 36' includes fingers generally designated 36A' having an arc resistant material, such as a tungsten matrix material infiltrated with copper or silver, 36B' disposed thereon. It is to be recalled that the finger tips 36B' are adapted to enclose the arc resistant surface 46' of the generally fixed electrode 28' as the movable electrode 30' is brought in contact therewith. The previously described annular fixed disc shaped member 102 is disposed upon an elongated rectangular support member 96 with keyway 98. Member 96 is secured to terminal 4A' by bolts or similar fastener means. There may be two members 96 disposed annularly within the electrically conducting cylinder 3'. The stationary piston member 102 is disposed at the other end of the support member 96 by way of bolts or similar fastening means 102E. There is a sandwich combination of members 102A and 102B which generally extend between the electrode 30' and the inner surface of the thin walled tube 23' and which partially enclose a smaller laminate portion 102C. The three latter mentioned members 102A, 102B, 102C act to support gas seal member 102D therein which in turn provides an effective gas seal for the chamber 60' between the member 102 and the cylinder 23' to the ambient gas pressure region 61B. Bolt 102E acts to hold in place a valve strip member 102F. Valve member 102F provides unidirectional gas flow in the direction 68' which is a similar function to that provided by the valve 62 in FIG. 2. In the member 92, connected to the bottom portion or end portion of the electrode 30, is a U-shaped member generally designated 92 which may be otherwise designated as a clevis member which interconnects the bottom portion of the electrode 30 with a linkage member generally designated 21' by way of a pin member generally designated 94, it being realized that there are two linkage members 21' on either side of the bight portion of the U-shaped clevis member 92 which are interconnected with the pivotal pin member 94. The clevis member 92 has a key portion 100 which moves longitudinally in the previously described keyway 98 in the support member 96 to prevent rotation of the electrode 30' and to provide support therefor.

The operation of the circuit interrupter depicted in FIG. 4 in regard to the flow of puffer gases is similar to the operation of the puffer described with respect to FIG. 2 inasfar as relative motion of the elements are concerned. The difference is that the movable and stationary members are interchanged between the embodiments of FIG. 2 and FIG. 4. In addition, in the embodiment of FIG. 2, the cylinder member generally designated 23, is fixedly attached to the spider 24, while in the embodiment of FIG. 4 it is fixedly attached to the cooler casting 38'. During an opening operation for the circuit contacts of the circuit interrupter, i.e., when contacts 30 is moved away from contact 28, the corresponding motion of the horn and cooler casting 40' and 38' respectively toward the relatively fixed gas sealed annular disc 102 causes gas to flow out of the compressed gas region 60' through the ducts 38A' between the rib portions of the cooler casting 38'. The flow of gas is generally designated 84'. As the flow of gas 84' enters the region of arc extinction 74, it splits into two parallel gas venting paths namely path 88, which causes the venting gas to flow downwardly through the hollow portion of the electrode 30' to the open end thereof where it vents past opened portions of the clevis 92 as indicated by the arrow 88A'. The other parallel gas path is generally designated 86 and it flows outwardly to the wider portion of the horn 48' past the outer peripheral surface of the generally fixed solid electrode 28A' past which the horn 40' is moving in a direction 82. In this embodiment of the invention there is provided a stationary copper alloyed spring loaded current conducting member or stationary collector finger **110*a*, which makes intimate electric contact with the movable contact 30' at a portion or place 110*b*. It is preferred to have four or more of the member 110*a*. The previously described finger or electrically conducting member 110*a* is secured to the terminal 4A' by a bolt or other similar fastening means 114. This provides for a path of high electrical conduction which is in series with the main body of the electrode 30' for carrying current from electrode 30' to terminal 4A'. The electrical interconnecting relationship between the electrode 30' and the fixed electrode 28' are the same as described with respect to FIG. 3.** The gas sealing interrelationship is also the same.

It is to be understood with respect to the embodiments of this invention, that the linkage means are not limiting nor is the electrical contact means limiting. As an example, the contact means 110 shown in FIG. 4 is not limiting as far as the embodiment of FIG. 4 is concerned, nor is the fixed sliding contact means 26 shown in the embodiment of FIG. 2 limiting. It is also to be understood with respect to the various embodiments of this invention that contacts such as 112 shown in FIG. 3 may be applied for the useful purpose in all the embodiments of the invention of shunting the contacts 36 and 28 to enable the device to carry a high value of continuous current. However they do not enter into the interrupting of the arc or completing of the circuit. It is also to be understood with respect to the embodiments of the invention that the various sealing and connecting means are not limiting. It is also to be understood with respect to the various embodiments of the invention that the unique arrangement of the insulating and arc resistant arc horn, cooler casting, and annular metal electrode and a metallic cluster nozzle in a fixed relationship with respect to each other is novel and its cooperation with respect to the other portions of the circuit interrupter provides for a novel circuit interrupter arrangement.

The apparatus embodying the teachings of this invention have several advantages. One advantage lies in the fact that the fixed interrelationship of the horn, cooler casting and annular electrode provide for a convenient shielding of the arc when the electrodes are drawn away from each other in an interrupting operation while at the same time providing dual venting paths for arc extinguishing gas blast puffer gas. In the embodiments of the invention an advantage lies in the fact that one of the dual paths is provided around the outside portion of an arcing electrode to more easily sweep the arc or interrupt the arc rather than through a central portion where the arc may not be conveniently interrupted. Another advantage lies in the fact that this latter arrangement of gas path flow provides for insulation between the outer portion of the electrodes once the arc has been extinguished. This type of insulation is most likely in the opinion of the inventor to prevent restrikes. The inventor has found with respect to the embodiments of this invention that the interrupting qualities of this invention are increased by at least a factor of two or more in terms of interrupted electrical current and rate of rise of recovered voltage which may be interrupted by the circuit breaker merely by providing a cooperating insulating arc horn and cluster nozzle arrangement as is specifically shown in the embodiments of the invention.

What is claimed is:

1. A gas-blast type of circuit-interrupter including, in combination:

a. a vented hollow contact having a plurality of circumferentially disposed inner contact fingers provided therewithin;

b. a cooperable relatively-solid non-vented contact extending interiorly within said plurality of circumferentially disposed inner contact fingers an appreciable extent in the closed-circuit position of the circuit-interrupter;

c. means defining an insulating hollow gas-flow nozzle member fixedly secured to said one vented hollow contact and through which said non-vented contact projects in the closed-circuit position of the interrupter;

d. piston means providing high gas pressure conditions externally of said vented hollow contact; and, e. the contacting interengagement between the non-vented contact and the vented hollow contact providing a closed-valve condition during a predetermined portion of the opening operation preventing gas flow from said high pressure source, whereby the gas pressure has adequate time to be built up.

2. The combination according to claim 1, wherein a perforated metallic cooler member (38A) is interposed between the vented hollow contact and the surrounding insulating hollow nozzle member.

3. The combination according to claim 2, wherein a relatively tight fit is provided between the non-vented contact and the orifice restriction (70) of the insulating hollow nozzle member to prevent gas flow.

4. The combination according to claim 1, wherein the vented hollow contact is stationary and the cooperable relatively solid non-vented contact is movable.

5. The combination according to claim 4, wherein the piston means comprises a movable piston member (54) which is fixedly secured to the movable non-vented contact.

6. The combination according to claim 1, wherein the vented hollow contact is movable and has a piston member fixedly secured thereto, and wherein the cooperable relatively solid non-vented contact is stationary.

7. A gas-blast type of circuit-interrupter including, in combination, means defining a tubular nonperforated metallic contact-holder carrying a ring-shaped metallic perforated cooler member adjacent one open end thereof, the other end of said metallic contact-holder being open to provide a gas-exhaust passage therethrough, an insulating hollow nozzle-member for directing gas flow disposed adjacent said ring-shaped metallic perforated cooler member for receiving a flow of high-pressure gas through said perforated metallic cooler member, means defining an annular cluster of circumferentially disposed contact-fingers disposed internally of said tubular nonperforated metallic contact-holder disposed closely adjacent the inner wall thereof, a substantially nonvented solid contact-rod making contacting engagement with said annular cluster of circumferentially disposed contact-fingers in the closed-circuit position of the circuit-interrupter, means for simultaneously separating said contacts to draw an arc and additionally creating high-pressure gaseous conditions externally of said tubular non-perforated metallic contact-holder during the opening operation of the interrupter, the substantially non-vented solid contact extending an appreciable distance into the interior of said annular cluster of contact-fingers in the closed-circuit position of the circuit-interrupter and additionally making a relatively tight fit within said orifice opening, thereby providing a valve-action therewith for closing the orifice opening in the nozzle during the initial portion of the opening operation of the interrupter to halt gas flow therethrough, separating motion of said contacts opening the aforesaid valve during arc establishment and thereby releasing a flow of high-pressure gas through the opened orifice opening and around the end tip of the substantially non-vented solid contact, and additional high-pressure gas being vented in the opposite direction through the annular cluster of contact-fingers and out through said gas-exhaust passage provided in the tubular contact-holder, whereby the arc will become extinguished by the gas flow in opposite directions.

8. The combination according to claim 7, wherein the tubular non-perforated metallic contact holder and the annular cluster of circumferentially disposed contact fingers are stationary, and the substantially non-vented solid contact rod is movable.

9. The combination according to claim 7, wherein piston means is utilized to provide the high-pressure gaseous conditions, said piston means including a movable piston member, and the movable piston member being fixedly secured to the substantially non-vented solid contact rod and movable therewith.

10. The combination according to claim 7, wherein the tubular non-perforated metallic contact holder and the annular cluster of circumferentially disposed contact-fingers are movable, and the substantially non-vented solid contact rod is stationary.

11. The combination according to claim 7, wherein piston means including a movable piston member is provided to create the high-pressure gaseous conditions, and the movable metallic contact holder and the annular cluster of circumferentially disposed contact-fingers are movable and fixedly attached to the movable piston.

* * * * *